US008127673B2

(12) United States Patent
Malottki

(10) Patent No.: US 8,127,673 B2
(45) Date of Patent: Mar. 6, 2012

(54) DEVICE FOR TURNING OVER SHEET MATERIAL

(75) Inventor: Joerg Von Malottki, Westensee/Brux (DE)

(73) Assignee: Eastman Kodak Company, Rochester, NY (US)

( * ) Notice: Subject to any disclaimer, the term of this patent is extended or adjusted under 35 U.S.C. 154(b) by 525 days.

(21) Appl. No.: 12/305,655

(22) PCT Filed: Apr. 10, 2007

(86) PCT No.: PCT/EP2007/003158

§ 371 (c)(1),
(2), (4) Date: Dec. 19, 2008

(87) PCT Pub. No.: WO2008/003360

PCT Pub. Date: Jan. 10, 2008

(65) Prior Publication Data

US 2010/0178090 A1 Jul. 15, 2010

(30) Foreign Application Priority Data

Jul. 7, 2006 (DE) ..... 10 2006 031 823

(51) Int. Cl.
*B41F 13/24* (2006.01)

(52) U.S. Cl. ..... 101/232; 101/230

(58) Field of Classification Search ..... 101/232
See application file for complete search history.

(56) References Cited

U.S. PATENT DOCUMENTS

| | | | | |
|---|---|---|---|---|
| 4,569,620 | A * | 2/1986 | Lynch | 412/21 |
| 4,844,442 | A | 7/1989 | Gammerler | |
| 5,467,179 | A * | 11/1995 | Boeck et al. | 399/384 |
| 5,860,053 | A | 1/1999 | Stemmle | |
| 5,996,491 | A * | 12/1999 | Kishine et al. | 101/223 |
| 6,044,760 | A | 4/2000 | Krueger | |
| 6,050,191 | A * | 4/2000 | Enderle et al. | 101/222 |
| 6,409,008 | B1 | 6/2002 | Newsome | |
| 6,666,399 | B2 * | 12/2003 | Perdu | 242/615.12 |
| 6,796,524 | B2 * | 9/2004 | Pollock et al. | 242/615.12 |
| 2002/0069774 | A1 | 6/2002 | Neumann | |
| 2004/0101404 | A1 | 5/2004 | Takemoto | |

FOREIGN PATENT DOCUMENTS

| | | |
|---|---|---|
| DE | 2529103 | 11/1978 |
| DE | 29622735 | 7/1997 |
| GB | 1561851 | 3/1980 |

* cited by examiner

*Primary Examiner* — Anthony Nguyen
(74) *Attorney, Agent, or Firm* — Donna P. Suchy; Christopher J. White

(57) ABSTRACT

The invention relates to a device for turning over sheet material, in a printing machine, such as verso-printing in an electrophotographic printing machine. The device includes driven web-shaped segments extending essentially parallel to each other over at least one section, such that the web-shaped segments clamp the individual sheets between the segments and turns over each sheet as it is transported along a transport path.

7 Claims, 3 Drawing Sheets

DEVICE FOR TURNING OVER SHEET MATERIAL

Figure 1:
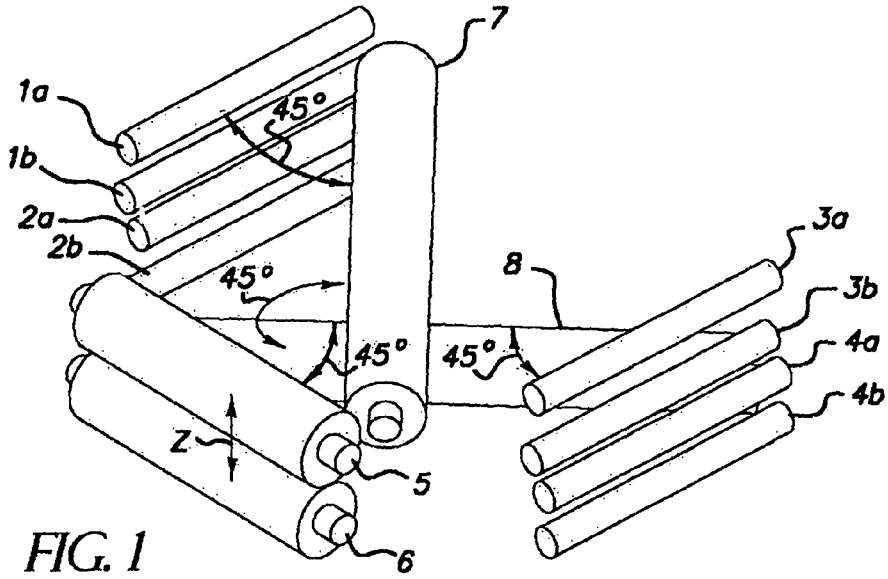

The invention relates to a device for turning over sheet material, preferably sheets of printing material, in a printing machine, preferably for verso-printing, preferably in a digital printing machine, preferably an electrophotographic printing machine, said device comprising driven web-shaped segments extending essentially parallel to each other over at least one section, said web-shaped segments clamping the individual sheet between them and thus transporting said sheet along a transport path, thus turning over said sheet.

A device for turning over sheets of the aforementioned type is known, for example, from DE 100 59913 C2.

The known device which actually functions quite well can pose problems in certain situations. Printing material sheets having certain dimensions, weights per unit area, stiffnesses or a curl can be turned over only with difficulty or not at all. Also, with some printing materials, the fiber advance direction affects the turning behavior of the sheets. In particular, sheets having a low weight per unit area and/or low stiffness collapse easily within themselves during the turn-over process when certain dimensions are exceeded. Light-weight materials also tend to crease. Sheets exhibiting great stiffness and/or a high weight per unit area need to be additionally guided during the turn-over process, which can be achieved, for example, with guides consisting of sheet metal, wires or the like. However, as a result of this, the sheets may be damaged. Sheet jams may be caused by each of the above circumstances. Curls and/or oil smears, in particular caused by toning oil, can exacerbate the problems.

The service life of the web-shaped belts of the known turn-over devices is relatively limited. In addition, older belts reduce the transport quality of the belts. Likewise, the production of the belts is relatively complex. With the known device, the sheets are held centered by the belts and are turned in a screw-like manner by helically turned belts. As a result of this, the belts are stressed relatively heavily, the balance of the sheets is relatively instable, the sheets' lateral overhang is large thus offering air resistance during the turn-over process, and a crossing and clamping of the belt segments required for turning over and holding the sheets must be maintained by guide rollers with collars.

The object of the invention is to provide a turn-over device of the aforementioned type, which grasps the sheets with the belt segments and guides them in a manner so as to be turned over in an easier and more secure manner.

In accordance with the invention, this object is achieved in that the clamping belt segments move together on the sheet transport path around at least one deflecting element which deflects them by approximately 180° in such a manner that the previously upper side of the sheet becomes the lower side of the sheet.

In the inventive turn-over device, the individual sheet material together with the belt segments clamping them is deflected and turned over advantageously, not in a helical direction, but essentially in a looping direction. This provides some advantages. For example, as a result of the joint deflection, the clamping effect of the belt segments is enhanced and maintained in a more reliable manner. Thus, the sheet material can be guided in a more stable manner and the turn-over process is particularly controlled and determinated. In addition, the web-shaped segments can also be configured wide, almost to any width, in particular configured more belt-like. This results in an improved guide surface, even for larger and stiffer sheets, and in less stress on the belt segments. The latter also increases the service life of the belt segments. It is also possible to use several parallel moving belt segments. As the contact surface of the sheets becomes larger, the material properties of the belt segments become less critical, so that said segments can be manufactured in a simpler and less expensive manner.

When the sheets are turned over—as is also true of the known turn-over device—the leading end of the sheet before said sheet is turned over remains the leading end after said sheet has been turned over. This is favorable in particular regarding the registration of such a sheet in a printing machine.

A modification of the inventive device provides that at least two deflecting rollers are arranged successively on the sheet transport path, said rollers ultimately also returning the individual sheet into its original transport direction. For the inventive guiding of the sheet, it is not so essential how often the sheet—with the belt segments—is guided around the deflecting elements. Even various directional changes are always possible, so that the turn-over path can be adapted particularly well to miscellaneous situations, in particular in a printing machine.

Therefore, another modification of the invention provides that at least two deflecting elements are oriented at an angle of approximately 45° relative to the advance direction of the belt segments, and/or that the minimum of two deflecting elements are essentially oriented parallel or at right angles relative to each other.

Also, it is possible that the minimum of two deflecting elements be supplemented by at least a third deflecting element that extends essentially in transverse direction to the advance direction of the belt segments, whereby the advance direction of the belt segments need not correspond—at least along sections—to the ultimately desired transport direction of the sheets. However, changes of the transport direction are also inherently possible with the inventive device.

A preferred modification of the invention is characterized in that the course of the belt segments is essentially looped to have approximately the shape of a T, in which case the individual sheet is transported—essentially approximately in transverse direction—out of its original transport direction in order to be later again transported into its original transport direction. As a result of this, a reliable turn-over and ultimately the retention of the transport direction are possible in a reliable manner and, at the same time, the device can be provided in a highly compact and space-saving manner in a small space. Overall, another advantage of the inventive device is that available space can be utilized in three dimensions with more degrees of freedom.

Another modification of the invention is even characterized in that the path, along which the individual sheet is carried, provides turning by a total of approximately 540°, whereby the sheet's upper side becomes its underside, again its upper side and finally again its underside.

Another significant advantage of the inventive device can be seen in that, in order to form all the belt segments, only one single, appropriately looped, belt is required, said belt being provided appropriately looped so that different belt segments of the same belt lie against each other and, moving in the same direction, become clamping belt segments for the sheets. In fact, the inventive device can be implemented, even in a particularly simple manner, with a single belt, in particular when the transport direction of the sheet is essentially the same before and after the turn-over process and when the belt segments are in alignment with each other before and after the turn-over process. Therefore, in particular, a closed web can also be provided, for example, with a belt lock. For example, it would also be conceivable to insert a ready-to-use looped belt with a type of cassette as the turn-over element into a device, in particular into a printing machine.

Although, due to the joint deflection of the belt segments and the individual sheet, the clamping action of the belt segments is enhanced and secured, it is also possible to provide at least one pair of deflecting elements, with which the deflecting elements cooperate—counter-rotating—as counter-bearing elements and form between them a guide nip for the clamping belt segments. The cooperating deflecting elements guide the belt segments holding the sheet sort of in the way of a heated mangle roll, even driving said belt segments, if desirable.

Another modification of the invention is characterized in that at least one first pair of cooperating deflecting elements for moving freely returning belt segments toward each other is provided to form the clamping belt segments, and a second pair of cooperating deflecting elements for the separation of the clamping belt segments is provided to form the freely returning belt segments. In this manner it is possible to particularly advantageously guide the freely returning belt segments in a variable manner and as needed, in particular, when only a single closed web is used.

In such an arrangement, the region of the first pair of cooperating deflecting elements can be provided for feeding the sheet to be turned over, and the region of the second pair of cooperating deflecting elements can be provided for ejecting the turned over sheet, i.e., sort of form the orifices of the inventive device which, at the same time offer suitable lateral threading sides for the individual incoming and outgoing sheets.

In order to achieve a particularly compact design of the device, it may additionally be provided that the deflecting elements are arranged and/or dimensioned in such a manner that the clamping belt segments are located in the space between the freely returning belt segments, in particular the freely returning belt segments, so that the returning belt-segments create a type of enclosure for the device.

Embodiments of the invention, which could result in additional inventive features, which, however, do not restrict the scope of the invention, are shown by schematic drawings.

They show in

Figure 2:
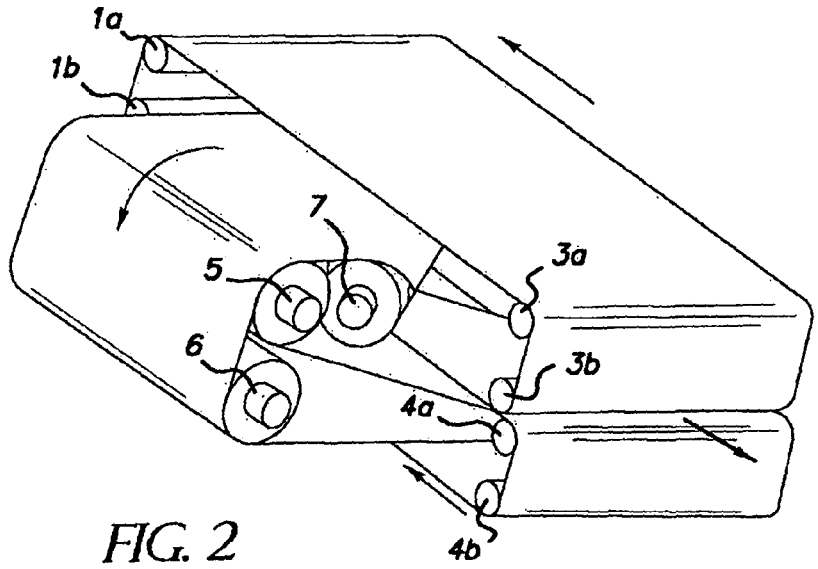
Figure 3:
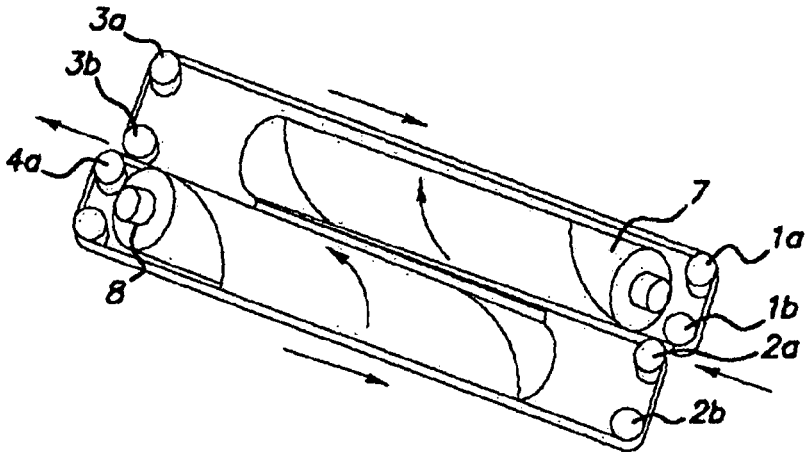
Figure 4:
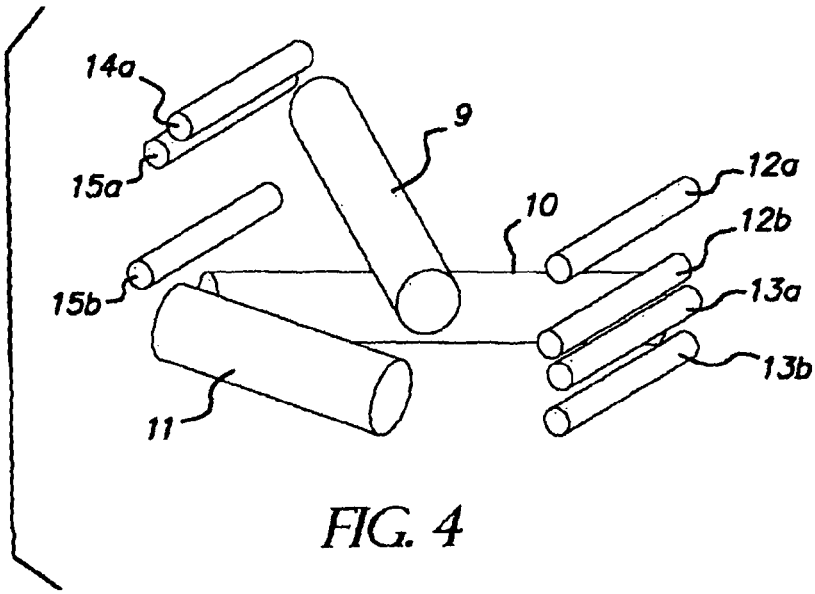
Figure 5:
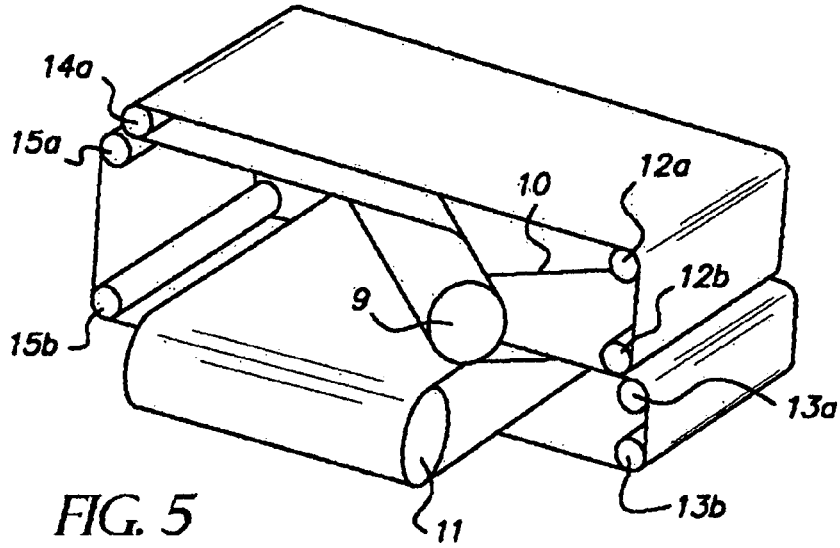
Figure 6:
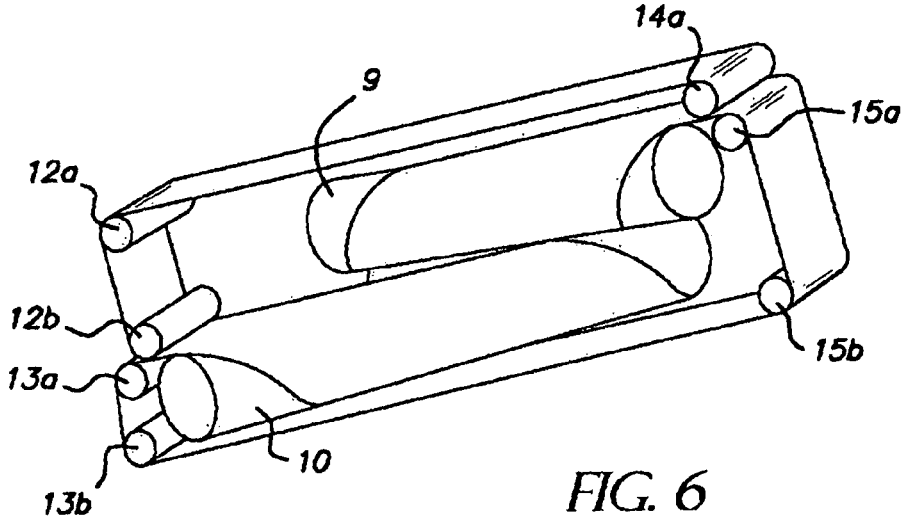

FIG. 1 a perspective view of the deflecting rollers for a first embodiment of an inventive turn-over device;

FIG. 2 a device in accordance with FIG. 1, comprising a transport belt for the sheets to be turned over, said belt being looped around the deflecting rollers;

FIG. 3 a side elevation of the device in accordance with FIG. 2;

FIG. 4 a perspective view of the deflecting rollers for a second embodiment of the inventive turn-over device;

FIG. 5 the device in accordance with FIG. 4, comprising a transport belt for sheets to be turned over, said belt being looped around the deflecting rollers; and, FIG. 6 a side elevation of the device in accordance with FIG. 5.

FIG. 1 is a perspective view of the deflecting rollers for a first embodiment of an inventive turn-over device.

FIG. 1 is a perspective view showing only the different deflecting rollers without the sheet-transporting and sheet-flipping web or belt. The entry for the individual sheet is formed by the deflecting rollers 1*b* and 2*a*, said rollers forming between them a feeding nip for the sheet and guiding said sheet into the turn-over device in the manner of the rolls of a mangle, whereby, in so doing, the sheet is transported in a clamped manner between the belt segments of a belt (not illustrated in FIG. 1 as already stated), whereby said belt segments are moved toward each other by the two deflecting rollers 1*b* and 2*a* and brought into contact with each other. In order to be moved toward each other, the free belt segments of the belt move over deflecting rollers 1*a* and 2*b*, to deflecting rollers 1*b* and 2*a*, respectively, into the nip or intermediate space formed by the deflecting rollers 1*b* and 2*a*.

The belt segments, which have been moved toward each other in this manner and which carry the sheet to be turned, then move on to a deflecting roller 7, said roller being oriented at an angle of 45° relative to the advance direction of the belt segments. The belt segments transporting the sheet then loop together around the deflecting roller 7—while carrying along the sheet—from the bottom to the top and move from there to a subsequent deflecting roller 5. During this process, the sheet is already being turned once by 180°, i.e., its underside is turned to become its upper side. The advance direction of the belt segments and the sheet is changed by the deflecting roller 7 by 90° out of the original transport direction.

The belt segments with the sheets move over the deflecting roller 5 to a deflecting roller 6, and from there to a deflecting roller 8. By being deflected around the deflecting rollers 5 and 6, the sheet is again turned by 180°, i.e., its original underside again becomes its underside.

Again, the deflecting roller 8 is at an angle of 45° relative to the advance direction of the belt segments that come from the deflecting roller 6, and the deflecting roller 8 is at an angle of 90°, i.e., transverse with respect to the deflecting roller 7. The belt segments also loop around the deflecting roller 8 from the bottom to the top and then move—taking along the sheet—to the deflecting rollers 3*b* and 4*a*. During the deflection of the belt segments around the deflecting roller 8 the sheet is turned a third time by 180°, and its original underside again becomes its upper side. Due to the deflection around the deflecting roller 8, the advance direction of the belt segments and the sheet again turns into the original transport direction.

The deflecting rollers 3*b* and 4*a* form an exit gap for the sheet, and the turned over sheet is ejected from the turn-over device while maintaining its leading end. When leaving the nip of the deflecting rollers 3*b* and 4*a*, the belt segments separate and move separately and freely to the deflecting rollers 3*a* and 4*b*, respectively, and from there back to the deflecting rollers 1*a* and 2*b*. During this whole process, only one single belt is used, said belt rotating in a closed manner and being appropriately looped within itself. While being turned, the sheet is preferably not accelerated, and the diameters of the deflecting rollers do not affect the turn-over behavior, but, preferably, the arrangement of the deflecting rollers relative to each other.

The movement of the belt as described in FIG. 1 can be repeated again in FIG. 2, whereby FIG. 2 again shows the deflecting rollers of FIG. 1, now with a belt, which in this case, too, is a single closed belt.

Due to the looping, the belt essentially moves in the form of a T, namely in the transport direction defined by the entry and exit gaps 1*b*, 2*a* and 3*b*, 4*a*, and once diagonally downward out of the latter gap to the deflecting rollers 5, 6 and back again into the transport direction. In addition, on their paths between the deflecting rollers 1*a* to 3*a* and 2*b* to 4*b*, the returning belt segments limit the remaining movement in a compact manner. Ultimately, this is essentially achieved by the diameters of the deflecting rollers 7 and 8 and, in view of this, by the distances of the deflecting rollers 1*b*, 3*b* and 2*a*, 4*a* from the deflecting rollers 1*a*, 3*a* and 2*b*, 4*b*.

FIG. 3 additionally shows the embodiment in accordance with FIG. 2, in a side elevation. The belt is preferably configured to have such a width that the sheet is enclosed completely or partially by the belt surfaces. Preferably, the belt is slightly wider or narrower than the maximum sheet format desired for transport.

FIG. 4 shows the deflecting rollers for a second embodiment of an inventive turn-over device, again initially without belt.

In this embodiment, the deflecting rollers 12*b* and 13*a* form an entry gap for the sheet to be turned and for the segments moved together which transport the sheet between them in a clamping manner. From there, the belt segments then move to another deflecting roller 10 which is oriented at an angle of 45° relative to the advance direction of the belt segments. The belt segments loop around this deflecting roller 10 from the top to the bottom and move to a deflecting roller 11. As a result of the deflection of the belt segments around the deflecting roller 10, the sheet is turned over by 180°, i.e., its underside becomes its upper side. In addition, due to this deflection, the advance direction of the belt segments is deflected by 90° out of the original transport direction.

The belt segments loop around the deflecting roller 11, again from the bottom, and then move on to a deflecting roller 9. Due to the deflection around the deflecting roller 11, the sheet is turned over a second time by 180°, i.e., its original underside again becomes its underside.

The deflecting roller 9 is again at an angle of 45° relative to the advance direction of the belt segments coming from the deflecting roller 11. The belt segments also loop around this deflecting roller 9, again from the bottom, and move on to the deflecting rollers 14*a* and 15*a*, which, between them, form an exit gap for the turned over sheets. Due to the deflection around the deflecting roller 9, the sheet has previously been turned over a third time by 180°, thereby again making its original underside its upper side. Furthermore, due to the deflection around the deflecting roller 9, the advance direction of the belt segments is again turned by 90° into the original transport direction.

When exiting from the exit gap between the deflecting rollers 14*a* and 15*a*, the belt segments are separated and move as free belt segments from the deflecting roller 14*a* to the deflecting roller 12*a* and from there back to the deflecting roller 12*b*, or from the deflecting roller 15*a* to the deflecting roller 15*b*, from there to the deflecting roller 13*b* and from there back to the deflecting roller 13*a*.

Therefore, the movement of the belt, which is again just one single belt, is similar to that of the first embodiment, in particular essentially T-shaped with respect to the transport direction and enclosed by the freely returning belt segments. In the two embodiments, the deflecting rollers 12*a*, 12*b*, 13*a*, 13*b* correspond to the deflecting rollers 1*a*, 1*b*, 2*a*, 2*b*, and the deflecting rollers 14*a*, 15*a*, 15*b* correspond to the deflecting rollers 3*a*, 3*b*, 4*a*, 4*b*. The deflecting rollers 9 and 10 correspond to the deflecting rollers 7 and 8, and the deflecting roller 11 corresponds to the deflecting rollers 5 and 6. As a result of the elimination of one deflecting roller 14*b*, i.e., by replacing the deflecting rollers 3*a* and 3*b* with only one single deflecting roller 14*a*, the turned over sheet exits on a level other than that from where it enters, when viewed in transport direction. By shifting the deflecting rollers in Z-direction (FIG. 1), however, the entry and exit in the first embodiment, too, can be located on different planes.

Also, the deflecting roller 11, by itself, replaces two deflecting rollers 5 and 6, and instead has a greater diameter.

In both embodiments, it is of course possible to reverse the entry gap and the exit gap, and, in so doing, the transport can take place in opposite direction.

FIGS. 5 and 6 show the deflecting rollers of FIG. 4, once again in a perspective view and in a side elevation with (a single closed) belt.

One difference in comparison with the first embodiment is that the sheet in the second embodiment is not always curved in the same direction when it is being turned over, so that the sheet does not retain a permanent roll deformation. On the other hand, with both embodiments, a previously existing roll deformation could be "ironed out".

Of course, various additional embodiments of the inventive turn-over device are conceivable. In particular, it is possible, as is basically shown by the embodiments, that, three times in total, a sheet can be turned over by 180° by two deflecting rollers each oriented at an angle of 45° in advance direction and another deflecting roller oriented in transverse direction. More deflecting rollers could be added or removed.

The generated surfaces of the deflecting rollers can be cylindrical or spherical, whereby spherical deflecting rollers automatically center the belt. One-piece and split belts—with or without belt lock—are conceivable. A belt-tensioning device may be provided, and/or the belts could be elastic. In order to be able to automatically center the belt, the deflecting rollers could comprise stop collars. In addition to the belts, additional supplementary guide elements could be provided.

The invention claimed is:

1. An inverter for turning a sheet traveling along a transport path in a printing machine, comprising:

a) two entrance rollers oriented essentially parallel to each other and arranged to form an entrance nip;

b) a plurality of deflecting rollers arranged along the transport path after the entrance rollers, the deflecting rollers not oriented essentially parallel to each other;

c) two exit rollers oriented essentially parallel to each other and arranged to form an exit nip, the exit rollers being arranged along the transport path after the deflecting rollers;

d) a guide roller oriented essentially parallel to the entrance rollers or the exit rollers; and e) a web-shaped clamping belt entrained around both entrance rollers, the deflecting rollers, both exit rollers, and the guide roller so that:

the clamping belt passes twice through the entrance nip and twice through the exit nip to define two clamping belt segments that face each other and move together from the entrance nip to the exit nip and two returning belt segments that move from the exit nip to the entrance nip;

the sheet entering the entrance nip is gripped between the clamping belt segments and transported by the clamping belt segments through the deflecting rollers to the exit nip; and the sheet is turned 180° around the direction of travel of the sheet while the sheet is transported.

2. The apparatus according to claim 1, wherein only one surface of the clamping belt is exposed to the sheet.

3. The apparatus according to claim 1, wherein at least two of the deflecting rollers are oriented at an angle of approximately 45° relative to an advance direction of the belt segments.

4. The apparatus according to claim 1, wherein at least two of the deflecting rollers are essentially at right angles relative to each other.

5. The apparatus according to claim 1, further including at least three deflecting rollers, at least one of which extends essentially in a transverse direction to an advance direction of the belt segments.

6. The apparatus according to claim 1, wherein the transport path forms a loop approximately the shape of a T, so that the sheet is transported an original first transport direction, and subsequently in a transverse direction from the original transport direction, and subsequently the original transport direction.

7. The apparatus according to claim 1, wherein sheet is turned by a total of approximately 540° between the entrance nip and the exit nip.

* * * * *